US010006140B2

(12) United States Patent
Chung et al.

(10) Patent No.: US 10,006,140 B2
(45) Date of Patent: Jun. 26, 2018

(54) METHOD FOR DYE-FREE COLORING OF ONE-TIME ANODIC ALUMINUM OXIDE SURFACE

(71) Applicant: NATIONAL CHENG KUNG UNIVERSITY, Tainan (TW)

(72) Inventors: Chen-Kuei Chung, Tainan (TW); Ming-Wei Liao, Tainan (TW); Bo-Yu Chu, Tainan (TW); Shu-Hsien Liao, Tainan (TW); Cheng-Hui Chen, Tainan (TW)

(73) Assignee: National Cheng Kung University, Tainan (TW)

( * ) Notice: Subject to any disclaimer, the term of this patent is extended or adjusted under 35 U.S.C. 154(b) by 54 days.

(21) Appl. No.: 15/211,355

(22) Filed: Jul. 15, 2016

(65) Prior Publication Data

US 2018/0016696 A1 Jan. 18, 2018

(51) Int. Cl.

| | |
|---|---|
| ***C25D 11/22*** | (2006.01) |
| ***C25D 11/04*** | (2006.01) |
| ***C25D 11/14*** | (2006.01) |
| ***C25D 5/18*** | (2006.01) |
| ***C25D 11/02*** | (2006.01) |

(52) U.S. Cl.
CPC ..... *C25D 11/22* (2013.01); *C25D 11/024* (2013.01); *C25D 11/04* (2013.01)

(58) Field of Classification Search
CPC ..... C25D 11/20; C25D 11/22
USPC ..... 205/173–174, 107
See application file for complete search history.

(56) References Cited

U.S. PATENT DOCUMENTS 4,152,222 A * 5/1979 Sheasby ..... C25D 11/22 205/174
2015/0368823 A1* 12/2015 Curran ..... C25D 11/26 205/50

* cited by examiner

*Primary Examiner* — Brian W Cohen
(74) *Attorney, Agent, or Firm* — Rosenberg, Klein & Lee

(57) ABSTRACT

A method for dye-free coloring of one-time anodic aluminum oxide surface is revealed. First provide a substrate containing aluminum. The substrate containing aluminum is anodized once at room temperature. The anodizing process includes a step of applying a pulse signal on the substrate containing aluminum for a first period of time. Thus a porous aluminum oxide layer is formed on surface of the substrate containing aluminum. The pulse signal includes a part with positive voltage and a part with negative voltage. Then a metal layer is deposited on the surface of the porous aluminum oxide layer. The porous aluminum oxide layer has a first interference wavelength. Next perform a linear regression of the first interference wavelength versus the first period of time. The absolute value of the slope of the regression line obtained ranges from 1.8 to 38.5. The absolute value is positively correlated with the positive voltage.

17 Claims, 11 Drawing Sheets

METHOD FOR DYE-FREE COLORING OF ONE-TIME ANODIC ALUMINUM OXIDE SURFACE

BACKGROUND OF THE INVENTION

Field of the Invention

The present invention relates to a method for coloring of anodic aluminum oxide (AAO) surface, especially to a method for dye-free coloring of one-time anodic aluminum oxide surface.

Descriptions of Related Art

Anodic aluminum oxide (AAO) is an aluminum oxide material with hexagonal pore arrays and is broadly applied to nanowire synthesis, nanofabrication, quantum dot fabrication etc. Generally, aluminum anodizing is an electrochemical process in which a compact aluminum oxide layer (AAO film) is built on the surface of aluminum or aluminum alloy. Thus an AAO substrate is formed. The compact AAO film not only protects the inner aluminum or aluminum alloy from further oxidation but also increases resistance to corrosion and wear, surface hardness and appearance properties of the aluminum-based material. The AAO substrate is widely used in housings of electronic or 3C products owing to the advantages mentioned above. In order to increase the aesthetic appearance of the housing of electronic or 3C products, structural colors of AAO have received considerable attention in recent years.

The AAO with structural colors available now are produced by at least two-time anodization of a thick/or high-purify aluminum (or aluminum alloy) substrate. Thus a regular array of nanopores is obtained and dyes or other materials can be filled into the nanopores to get specific colors of the substrate. Moreover, the anodizing is an exothermic reaction. Thus anodization is carried out in acidic solution at low temperature (−1 to 10° C.) to prevent damages of the nanoporous structural caused by Joule heat generated during the process. For example, China Patent No. 102181902 "Method for coloring aluminum and alloy surface thereof" issued on 16 Jan. 2013, disclosed a method of coloring the aluminum alloy surface by two-time anodization at a temperature of 0° C. to 5° C.; however, it must conduct the $2^{nd}$-time anodization with 50-300 periods of continuous 5-step anodization for coloring aluminum and alloy surface; Taiwan Patent No. I248479 "Aluminum product with film capable of varying color according to change of visual angle and method for forming film capable of varying color according to change of visual angle on aluminum basis metal base material" issued on 1 Feb. 2006, disclosed a method of carrying out anodic oxidation treatment on the aluminum basis metal base material to provide an anodic oxidation film of aluminum comprising a porous layer and a barrier layer and depositing the metal deposition in the holes of the porous layer for performing electrolysis coloration of anodic oxidation film of aluminum; however it conducts two- or three-time anodization with sulfuric acid and phosphoric acid. Therefore the production process of the colored substrate takes time and cost. Additionally, some other patents such as Taiwan patent publication No. 201227822 "Method for manufacturing nano-structure patterned substrate" issued on 1 Jul. 2012, disclosed the following steps of growing an aluminum film directly on a substrate, then using two-time anodic oxidation method to process the aluminum film to an anodic oxidized aluminum layer with nanometer hole structures; Taiwan patent publication No. 200722559 "Metal nanodot arrays and fabrication methods thereof" issued on 16 Jun. 2007, disclosed a method to deposit a block copolymer of polymer film on a conductive substrate, then deposit the metal material in the nano pore by electroplating process and U.S. patent publication No. 20090242410 "Method for electrochemical plating and marking of metals" provided a electrochemical plating process to electroplating the metal surface with the electroplating solution. These prior arts has disclosed the electroplating process, but none of these prior arts mentioned technique for coloring on the substrates.

SUMMARY OF THE INVENTION

Therefore it is a primary object of the present invention to provide a method for dye-free coloring of one-time anodic aluminum oxide surface in which AAO substrates with colors are produced by only one-time anodizing with specific settings of electrochemical parameters and without using dyes. Different patterns can also be formed by masks and protective layers.

In order to achieve the above object, a method for dye-free coloring of one-time anodic aluminum oxide surface according to the present invention includes the following steps. Firstly provide a substrate containing aluminum. Then perform one-time anodizing of the substrate containing aluminum at room temperature. The one-time anodizing of the substrate means applying a pulse signal to the substrate containing aluminum for a first period of time. Thus a porous aluminum oxide layer is formed on the substrate. The pulse signal consists of a part with positive voltage and a part with negative voltage. Next deposit a metal film on the porous aluminum oxide layer to display specific colors. The porous aluminum oxide layer has a first interference wavelength. Then perform a linear regression of the first interference wavelength versus the first period of time. The absolute value of the slope of the regression line obtained ranges from 1.8 to 38.5. The absolute value of the slope is positively correlated with the positive voltage.

The positive voltage of the pulse signal applied is ranging from 20 Volts to 60 Volts. The absolute value of the linear regression coefficient that reveals the relationship between the interference wavelength and the first period of time (the slope of the regression line) is 2.0±0.5 when the positive voltage is set as 20 V. The absolute value of the linear regression coefficient is 3.5±0.5 when the positive voltage is set as 30 V. The absolute value of the linear regression coefficient is 6.4±0.5 when the positive voltage is set as 40 V. The absolute value of the linear regression coefficient is 16.8±0.5 when the positive voltage is set as 50 V. The absolute value of the linear regression coefficient is 36.9±0.5 when the positive voltage is set as 60 V.

The substrate containing aluminum with the porous aluminum oxide layer is immersed in an etching solution to perform a pore-widening process for a second period of time before the step of depositing the metal film on surface of the porous aluminum oxide layer. The porous aluminum oxide layer has a second interference wavelength. The absolute value of the linear regression coefficient that reveals the relationship between the second interference wavelength and the second period of time is ranging from 1.5 to 8.0 and is negatively correlated with the positive voltage applied.

The absolute value of the linear regression coefficient that shows the relationship between the second interference wavelength and the second period of time is 7.3±0.5 when the positive voltage is set as 20 V. The absolute value of the linear regression coefficient that shows the relationship between the second interference wavelength and the second period of time is 3.4±0.5 when the positive voltage is set as 30 V. The absolute value of the linear regression coefficient that shows the relationship between the second interference wavelength and the second period of time is 2.6±0.5 when the positive voltage is set as 40 V.

A protective layer is covered on a part of the surface of the porous aluminum oxide layer before the pore-widening process, and then is removed after the pore-widening process. Later the substrate containing aluminum with the porous aluminum oxide layer is immersed in the etching solution to perform the pore-widening process once again.

The purpose of immersing the substrate containing aluminum in the etching solution for the pore-widening process is to make the substrate containing aluminum with the porous aluminum oxide layer have various interference wavelengths and different optical properties/colors.

The substrate containing aluminum can be a substrate made of pure aluminum, a substrate made of aluminum alloy, a substrate deposited with an aluminum layer and a substrate deposited with an aluminum alloy layer.

The thickness of the aluminum layer is ranging from 10 nm to 1000 nm.

The metal film is made from metal whose reflectivity is higher than 70%. The thickness of the metal film is ranging from 5 nm to 25 nm.

The metal film is made of platinum (Pt), aluminum (Al), silver (Ag), gold (Au), iron (Fe), nickel (Ni), cobalt (Co), chromium (Cr), titanium (Ti), Tantalum (Ta), copper (Cu), or their alloys.

The room temperature is ranging from 15 degrees Celsius (° C.) to 35° C.

The waveform of the pulse signal can be a square wave, a sine wave, a triangle wave or a sawtooth wave.

The absolute value of the part of the pulse with positive voltage is larger than the absolute value of the part of the pulse with negative voltage.

The method for dye-free coloring of one-time anodic aluminum oxide surface of the present invention features on that the anoidizing process is performed only one time and no dyes are required for production of the AAO substrate with colored surface. The color of the AAO surface can be controlled by setting electrochemical parameters. Compared with the manufacturing of the AAO substrate available now that required at least two times of the anodizing process or additional chemical dyes for coloring, the production time is reduced and pollution produced during the process is much lowered. Moreover, the method can be run at room temperature so that no temperature controller is required. This leads to significant energy and cost savings.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn functions and purposes of the present invention, please refer to the following embodiments and related figures.

Figure 1A:
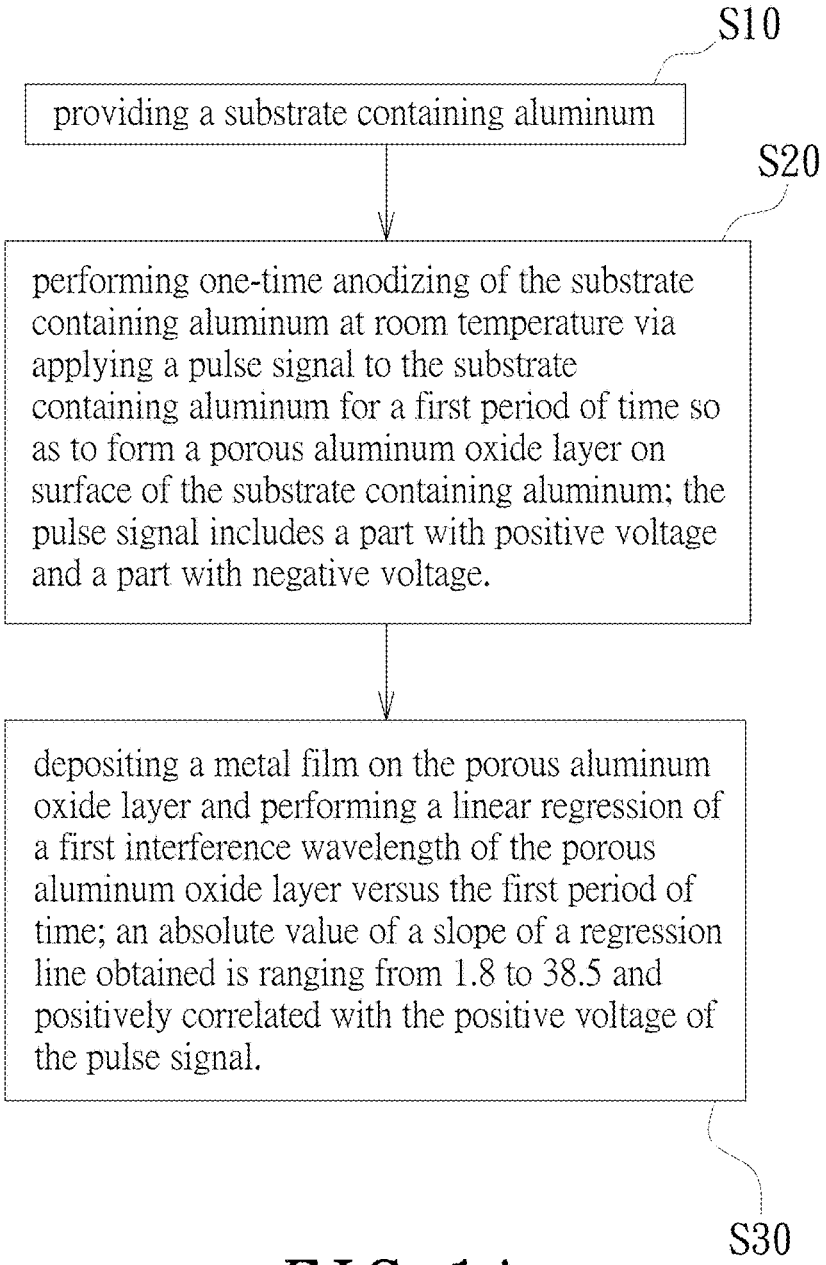
FIG. 1A is a flow chart showing steps of an embodiment according to the present invention.
Figure 1B:
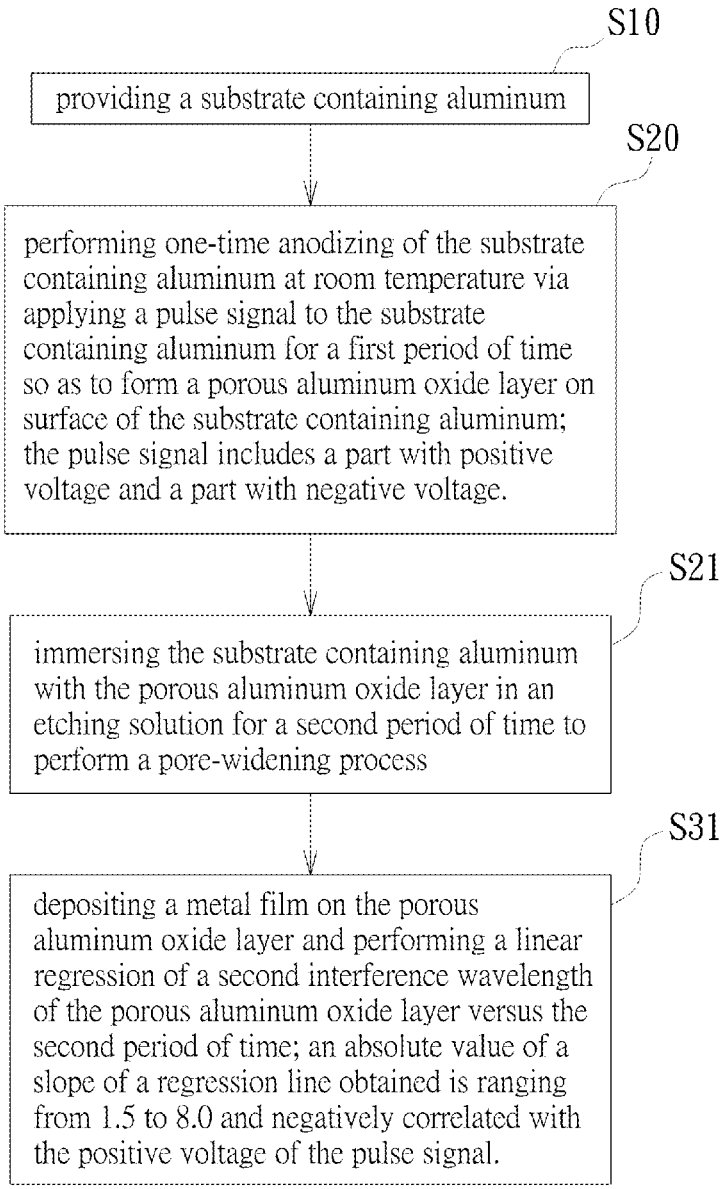
FIG. 1B is a flow chart showing steps of another embodiment according to the present invention.

Refer to FIG. 1A and FIG. 1B, two flowing charts showing steps of respective embodiment are disclosed. No dyes are required by the present method and the anodizing process is performed only once to get a colored anodic aluminum oxide (AAO) surface.

Refer to FIG. 1A, a method for dye-free coloring of one-time anodic aluminum oxide surface according to the present invention includes the following steps. First provide a substrate containing aluminum (step S10). Then take the step S20, perform one-time anodizing of the substrate containing aluminum at room temperature ranging from 15° C. to 35° C. The one-time anodizing of the substrate means applying a pulse signal to the substrate containing aluminum for a first period of time so as to form a porous aluminum oxide layer on surface of the substrate. The pulse signal includes a part with positive voltage and a part with negative voltage. The absolute value of the part with positive voltage is larger than the absolute value of the part with negative voltage. Next run the step S30, deposit a metal film on the porous aluminum oxide layer.

Figure 2:
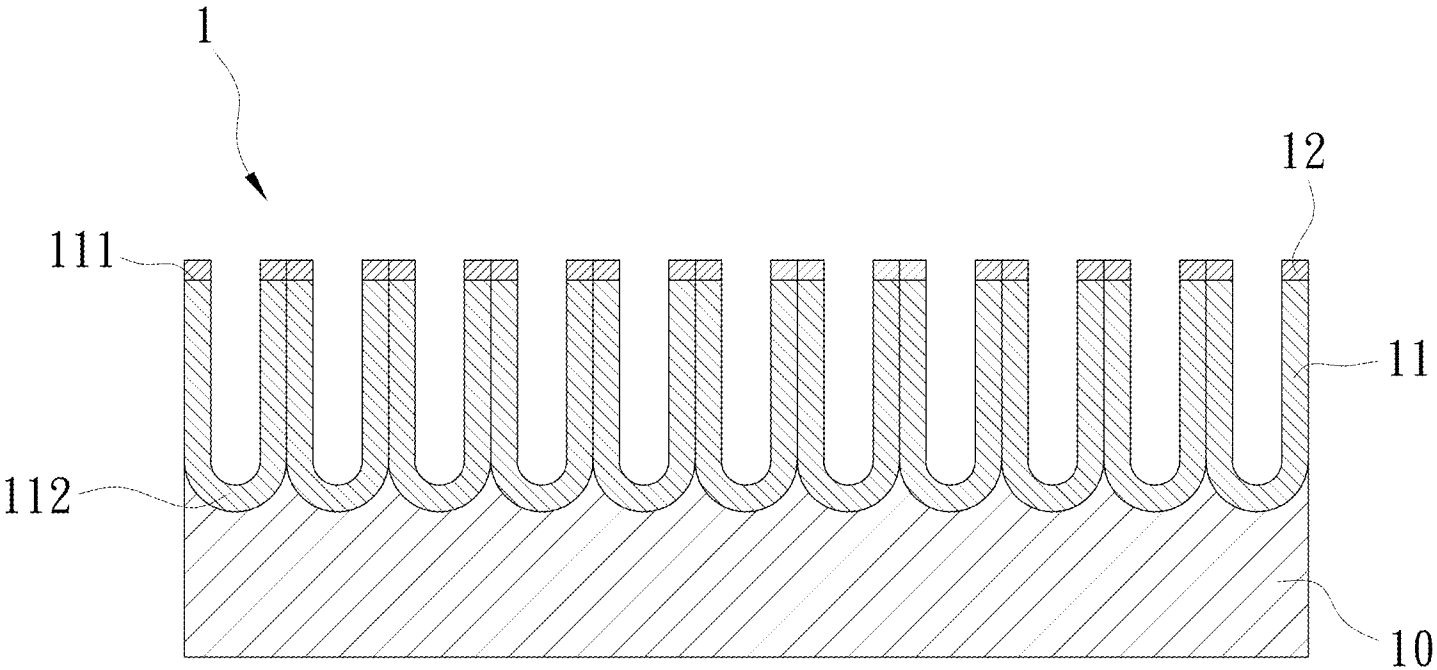
FIG. 2 is a schematic drawing showing a colored substrate produced by the method shown in FIG. 1A and FIG. 1B according to the present invention.

Refer to FIG. 2, a schematic drawing showing a colored substrate produced by the method shown in FIG. 1A and FIG. 1B is revealed. In the step S10, a substrate containing aluminum 10 provided can be an aluminum substrate, an aluminum alloy substrate, a substrate deposited with an aluminum layer or a substrate deposited with an aluminum alloy layer. As to the substrate deposited with an aluminum layer, the aluminum layer is homogeneously formed on a surface of the substrate by electrodeposition, vapor deposition, or sputtering deposition. The thickness of the aluminum or aluminum alloy coating is ranging from 10 to 1000 nm. In this embodiment, the aluminum is coated on the surface of a substrate by using a magnetron sputtering system. The substrate can be made from, but not limited to, glass, plastic, metal or silicon. The aluminum target with purity of 99% to 99.999% is sputtered on the surface of a silicon substrate so as to form an aluminum film deposited on surface of the silicon substrate. Thus a substrate containing aluminum 10 is produced. The substrate used in this embodiment is the silicon substrate and the target is 95%~99.99% aluminum. The sputtering power is 50 Watts (W) while the base pressure is below $2\times10^{-6}$ Torr and the working pressure is maintained at $1.7\times10^{-3}$ Torr during gas introduction. The preferred distance between the target material and the substrate is 100 mm and the deposition time is 30 minutes. Thus the aluminum film is deposited on the surface of the silicon substrate to form the substrate containing aluminum 10 of the present invention. In other embodiments, the sputtering power is ranging from 20 W to 150 W, the base pressure is between $1\times10^{-6}$ Torr and $9\times10^{-6}$ Torr, and the working pressure is from $1\times10^{-3}$ Torr to $9\times10^{-2}$ Torr. The distance between the target material and the substrate is ranging from 50 mm to 200 mm while the deposition time is ranging from 10 min to 120 min.

Figure 3:
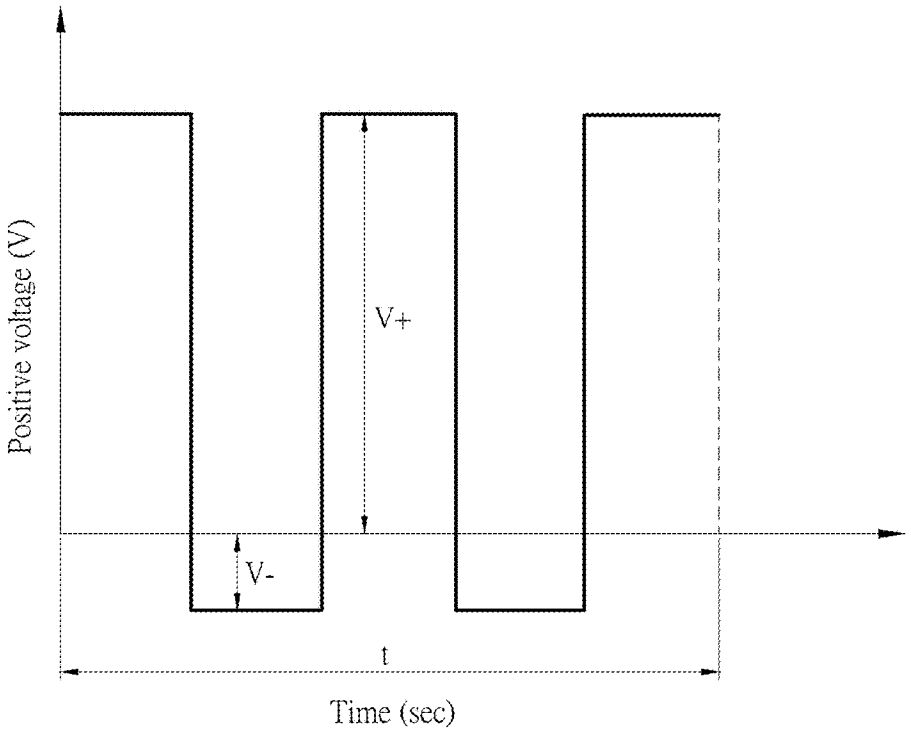
FIG. 3 is a schematic drawing showing pulse signals used in an embodiment according to the present invention.

In the step S20, the substrate containing aluminum 10 is anodized once at room temperature. The anodizing of the substrate 10 is for depositing a dense aluminum oxide layer on the surface of aluminum or aluminum alloy by the electrochemical process. Thus the color required is shown on the surface of the substrate containing aluminum 10. The anodizing includes a step of applying a pulse signal to the substrate containing aluminum 10 for a first period of time ($t_1$, second (unit)) to form a porous aluminum oxide layer 11. As shown in FIG. 3, the pulse signal is composed of a part with positive voltage (V+) and a part with negative voltage (V−). The positive voltage ranges from +20 V to +60 V and the negative voltage is −2 V. Refer to FIG. 3, a waveform of the pulse signal in this embodiment is a square wave. The waveform of the pulse signal can also be a waveform of the pulse signal can be a sine wave, a triangle wave or a sawtooth wave. The first period of time $t_1$ is the period the substrate containing aluminum 10 processed by the pulse signals.

In this embodiment, the anodizing process is performed by using a 3-electrode potentiostat that includes a target substrate as the working electrode, a platinum wire as the counter electrode, and the Ag/AgCl as the reference electrode. A 0.3 M oxalic acid solution is used as the electrolyte. The substrate containing aluminum 10 is immersed in the electrolyte and then is applied with at least one pulse signal for a first period of time ($t_1$, second). The operation period of the pulse signal is 2 seconds (1 second for the part with positive voltage and 1 second for the part with negative voltage). After a period of time (the first period of time $t_1$), a porous aluminum oxide layer 11 with a plurality of regularly-arranged nanopores is formed on the substrate containing aluminum 10. The anodizing process in the step S20 is carried out at room temperature. In this embodiment, the room temperature is ranging from 15° C. to 35° C. and no temperature controller is required to reduce or maintain the electrolyte at the low temperature level (such as the temperature ranging from 0° C. to 10° C.). The stable nanopores are formed without damages caused by Joule heat dissolution effect at high temperature.

The porous aluminum oxide layer 11 formed on the surface of the substrate containing aluminum 10 by the above step S20 has a first interference wavelength. Light beams emitted to the porous aluminum oxide layer 11 are reflected by a top surface 111 and a bottom surface 112 of the porous aluminum oxide layer 11 owing to the regularly-arranged nanopores of the porous aluminum oxide layer 11. The reflected light beams interfere with each other to provide a new light wave. This phenomenon is called interference. The wavelength of the new light wave is called the interference wavelength in this embodiment. In this embodiment the first interference wavelength the porous aluminum oxide layer 11 has means the wavelength of the new light wave generated due to interference of the light beams reflected by the porous aluminum oxide layer 11 when light beams are emitted to the porous aluminum oxide layer 11.

Figure 6A:
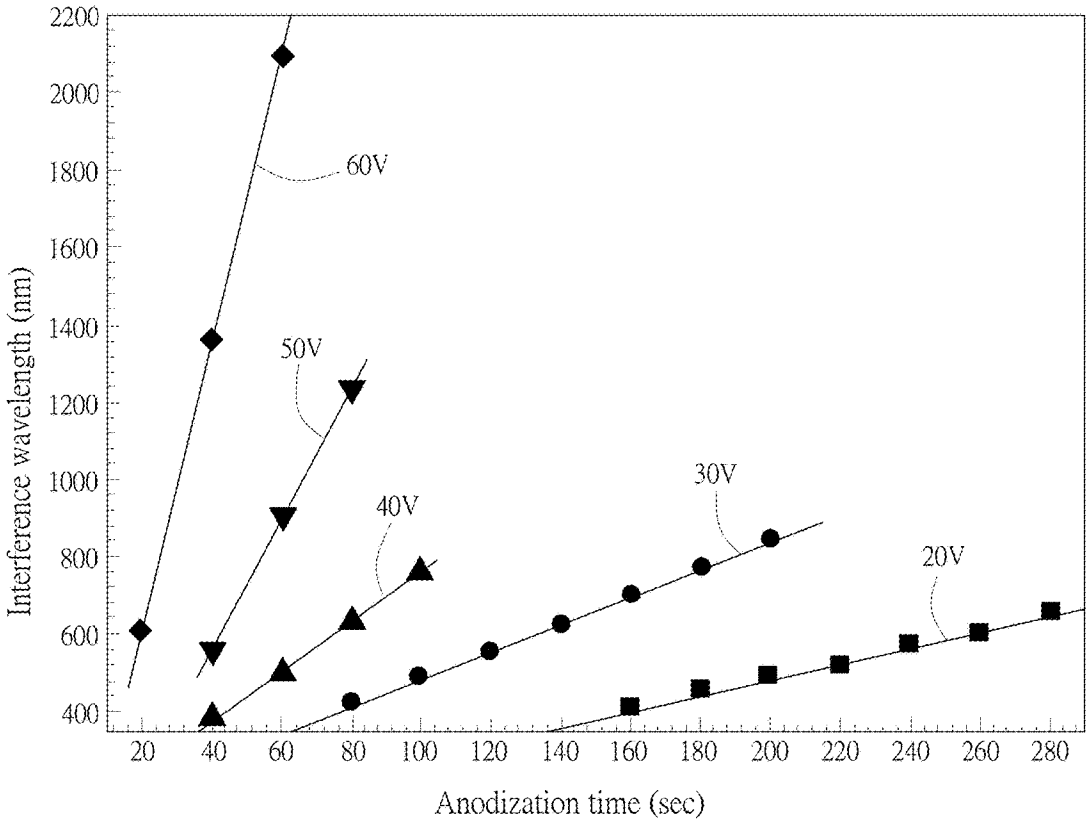
FIG. 6A shows results of a linear regression of the first interference wavelength versus the anodization time of a porous aluminum oxide layer of a colored substrate being applied with different positive voltages of the embodiments in FIG. 5A according to the present invention.

Refer to FIG. 6A, results of linear regression of the first interference wavelength versus the first period of time are revealed. The absolute value of the slope of the regression line obtained ranges from 1.8 to 38.5. The absolute value of the slope is positively correlated with the positive voltage V+. That means the absolute value of the slope is increased as the positive voltage V+ increases. For example, the absolute value of the slope of the regression line that reveals the relationship between the interference wavelength and the first period of time $t_1$ (unit: second) is 2.0±0.5 when the positive voltage V+ in the step S20 is set as 20 V. The absolute value of the slope of the regression line obtained is 3.5±0.5 when the positive voltage V+ is set as +30 V. The absolute value of the slope of the regression line obtained is 6.4±0.5 when the positive voltage V+ is set as 40 V. The absolute value of the slope of the regression line obtained is 16.8±0.5 when the positive voltage V+ is set as 50 V. The absolute value of the slope of the regression line obtained is 36.9±0.5 when the positive voltage V+ is set as 60 V. The details are shown in the following experiments.

For coloring the surface of the porous aluminum oxide layer 11, the first interference wavelength of this embodiment is the wavelength of visible light, ranging from 380 nm to 780 nm. In this embodiment, the interference wavelength of the porous aluminum oxide layer 11 is controlled by the anodization time (the first period of time $t_1$) during which different voltages are applied.

Take the visible violet color with a wavelength of 400 nm as an example. The first period of time $t_1$ required for anodization can be calculated according to the linear function obtained by linear regression. Thus users can produce the substrate 1 with violet color on the surface thereof by setting the first period of time $t_1$ required (time for one-time anodization) in the step S20.

Refer to FIG. 1B, for adjustment of the color shown on the surface of the substrate 1, a pore-widening process (step S21) is carried out before the step of depositing a metal film on the porous aluminum oxide layer 11 (step S31). The substrate containing the aluminum 10 processed by the step S20 and having the porous aluminum oxide layer 11 is immersed in an etching solution for a second period of time $t_2$ (unit: minute) for performing the pore-widening process. The step S31 in FIG. 1B and the step S30 shown in FIG. 1A are the same in the step of depositing a metal film on the porous aluminum oxide layer 11 while the embodiment in FIG. 1B further includes a step of performing the pore-widening process (step S21). The difference between the step S31 and the step S30 is in that the linear regression performed is to explain the relationship between the second interference wavelength and the second period of time in the step S31.

Refer to FIG. 1B, the porous aluminum oxide layer 11 has a second interference wavelength after the pore-widening process in the step S21. Similarly, perform a linear regression of the second interference wavelength versus the second period of time $t_2$ (unit: min) The absolute value of the slope of the regression line obtained is ranging from 1.5 to 8.0 and is negatively correlated with the positive voltage (V+). That means the absolute value of the slope is reduced as the positive voltage (V+) increases. When the positive voltage V+ is set as 20 V, the absolute value of the linear regression coefficient that reveals the relationship between the second interference wavelength and the second period of time $t_2$ is 7.3±0.5. The absolute value of the linear regression coefficient is 3.4±0.5 when the positive voltage V+ is set as 30 V. The absolute value of the linear regression coefficient is 2.6±0.5 when the positive voltage V+ is set as 4 0V.

The substrate containing aluminum 10 can also have two different colors in different areas respectively by adjusting the pore-widening time of the respective area. Before the step of immersing the substrate containing aluminum 10 with the porous aluminum oxide layer 11 in an etching solution in the step S21, a protective layer is disposed on a part of the surface of the porous aluminum oxide layer 11. Then the protective layer is removed after the pore-widening process (for a period of (a) minutes) of the substrate containing aluminum 10 in the step S21. Then the substrate containing aluminum 10 with the porous aluminum oxide layer 11 is soaked into the etching solution again to perform a second-time pore-widening process for a period of (b) minutes. The part of surface area of the porous aluminum oxide layer 11 covered by the protective layer is treated by the pore-widening process for (b) minutes while the rest surface area of the porous aluminum oxide layer 11 without being covered by the protective layer is treated by the pore-widening process for (a)+(b) minutes. Thus the two areas of the porous aluminum oxide layer 11 have different second interference wavelength owing to different pore-widening time. The different pore-widening time causes variations in colors on the surface of the porous aluminum oxide layer 11.

The protective layer can be photoresist (positive or negative), tape, screen-printing inks, etc. The protective layer can be used in combination with different photo masks and lithography process to form a specific pattern the users need.

Refer to FIG. 1A, FIG. 1B and FIG. 2, run the step S30 to deposit a metal layer 12 on the pore widened porous aluminum oxide layer 11 of the substrate containing aluminum 10. The metal layer 12 is formed by a metal with a reflectivity higher than 70%, including platinum (Pt), aluminum (Al), silver (Ag), gold (Au), iron (Fe), nickel (Ni), cobalt (Co), chromium (Cr), titanium (Ti), Tantalum (Ta), copper (Cu), and their alloys. The thickness of the metal layer 12 is ranging from 5 nm to 25 nm.

In another embodiment of the present invention, a substrate with colored surface 1 produced by the method of the present invention includes a substrate containing aluminum 10, a porous aluminum oxide layer 11 and a metal layer 12, as shown in FIG. 2. The porous aluminum oxide layer 11 is formed on a surface of the substrate containing aluminum 10 and having a thickness ranging from 5 nm to 1000 nm while 5 nm~500 nm is preferred. The porous aluminum oxide layer 11 is produced on a surface of the substrate containing aluminum 10 by the step S10, the step S20 and the step S30 of the first embodiment. The treatment parameters (the positive voltage V+, the negative voltage V−, the first period of time $t_1$, the second period of time $t_2$) of each step, the detailed physical parameters (the first interference wavelength, and the second interference wavelength) of the porous aluminum oxide layer 11 and the relationship between the parameters (the slope of the regression line) are the same as those of the embodiment mentioned above.

In a further embodiment of the present invention, a substrate with colored surface 1 produced by the method of the present invention includes a substrate containing aluminum 10, a porous aluminum oxide layer 11 and a metal layer 12, also as shown in FIG. 2. The porous aluminum oxide layer 11 is formed on a surface of the substrate containing aluminum 10 and having a thickness ranging from 5 nm to 500 nm. The porous aluminum oxide layer 11 is produced on a surface of the substrate containing aluminum 10 by the step S10, the step S20, the step S21 and the step S31 of the second embodiment. The treatment parameters (the positive voltage V+, the negative voltage V−, the first period of time $t_1$, the second period of time $t_2$) of each step, the detailed physical parameters (the first interference wavelength, and the second interference wavelength) of the porous aluminum oxide layer 11 and the relationship between the parameters (the slope of the regression line) are the same as those of the embodiment mentioned above.

In summary, colored substrates with different colors are produced by the present invention without using dyes and the anodizing process is carried out only once. The color on the AAO substrate is controlled by specific settings of electrochemical parameters. Compared with the method for manufacturing AAO substrates available now that requires at least two times of anodizing processes or chemical dyes, the method of the present invention shortens the production time and reduces the pollution generated. Moreover, no temperature controller is used because the present method can be performed at room temperature. Thus the overall cost and energy consumption during the process are reduced. In order to get or enhance the color, people skilled in the art can produce colored substrates according to the method of the present invention and followed by other treatments including painting, dyeing, etc.

Please refer to the following experiments.

Experiment one: preparation of a colored substrate

First deposit an aluminum thin film on a silicon substrate by using a magnetron sputtering system. The aluminum target is 2-inch thick with a purity of 99.99%. The sputtering power is 50 Watts while the base pressure is below $2\times10^{-6}$ Torr and the working pressure is maintained at $1.7\times10^{-3}$ Torr during gas introduction. The distance between the aluminum target and the substrate is 100 mm and the deposition time is 30 minutes. Then the anodizing process is carried out at room temperature ranging from 15° C. to 35° C. In this embodiment, the room temperature is 25° C. Moreover, three different pulse singles are applied to the substrate. The positive voltage is 40 V, 50 V, and 60 V respectively while the negative voltage applied is −2 V. The operation period is 2 seconds (1 second for the part with positive pulse and 1 second for the part with negative pulse). A three-electrode potentiostat (Jiehan 5000, Taiwan) is used to perform the anodizing process for 45 seconds (the time ($t_1$) the pulse signal applied to the substrate). An aluminum plate is used as the working electrode, a platinum wire serves as the counter electrode and the reference electrode is Ag/AgCl. 0.3 M oxalic acid solution is used as the electrolyte. Then the substrate is soaked in a 5% (wt %) phosphoric acid solution at room temperature for the pore-widening process. The pore-widening is carried out for 0, 20 min, 40 min, and 60 min respectively. Thus a porous aluminum oxide layer is formed on the substrate. At last, the surface of the substrate is coated with a platinum layer. The current is set at 20 mA and the coating time is 2 minutes.

Figure 4:
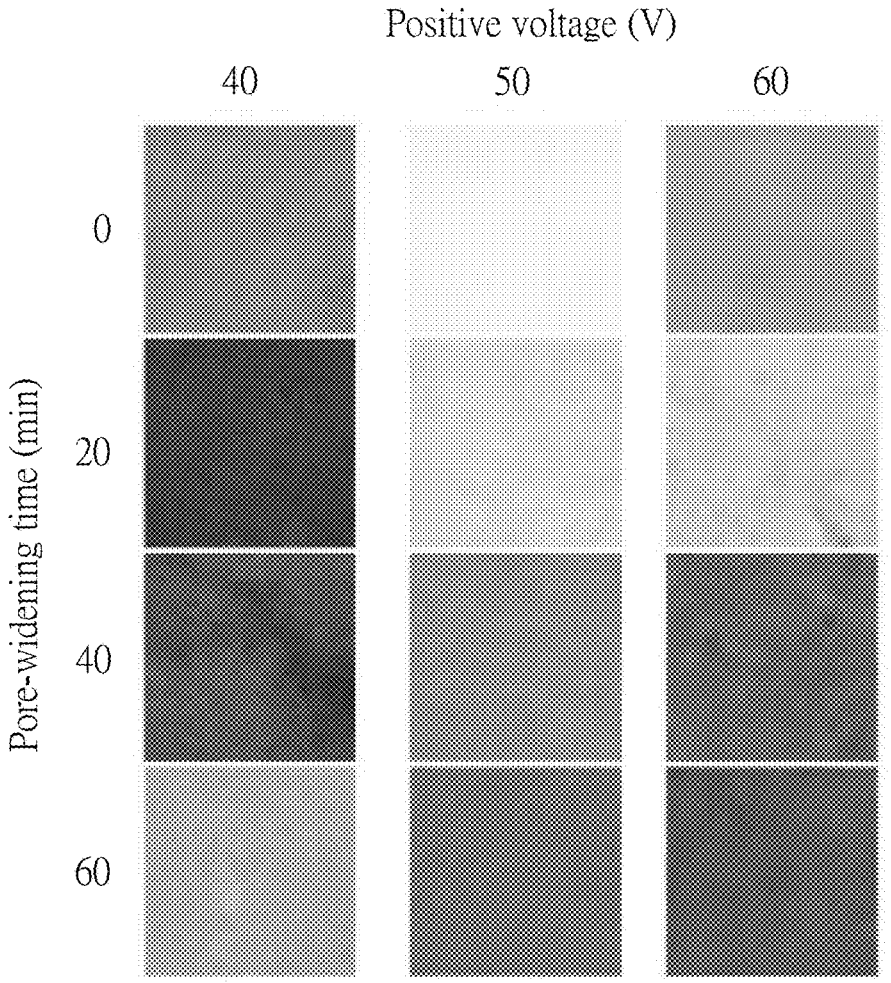
FIG. 4 shows substrates with different colors produced by high positive voltages applied in combination with different pore-widening time of an embodiment according to the present invention.

Colors of the colored substrate obtained by the above processes are shown in FIG. 4. As shown in the FIG. 4, the color on the surface of the colored substrate obtained is light blue when the positive operating voltage applied is 40 V and the pore-widening time is 0 min. Once the pore-widening time is increased (up to 20-60 min), the surface color of the substrate is changed to deep blue, dark brown or light brown. The color on the surface of the colored substrate produced is light yellow when the positive operating voltage applied is 50 V and the pore-widening time is 0 min Once the pore-widening time is increased (up to 20-60 min), the surface color of the substrate is changed to light sky blue, sky blue or light puce. The color on the surface of the colored substrate produced is tangerine when the positive operating voltage applied is 60 V and the pore-widening time is 0 min Once the pore-widening time is increased (up to 20-60 min), the surface color of the substrate is changed to bright-grass green, aquamarine or purple.

Experiment two: relationship between the positive voltage and the anodization time (the first period of time $t_1$)/the pore-widening time (the second period of time $t_2$).

Figure 5A:
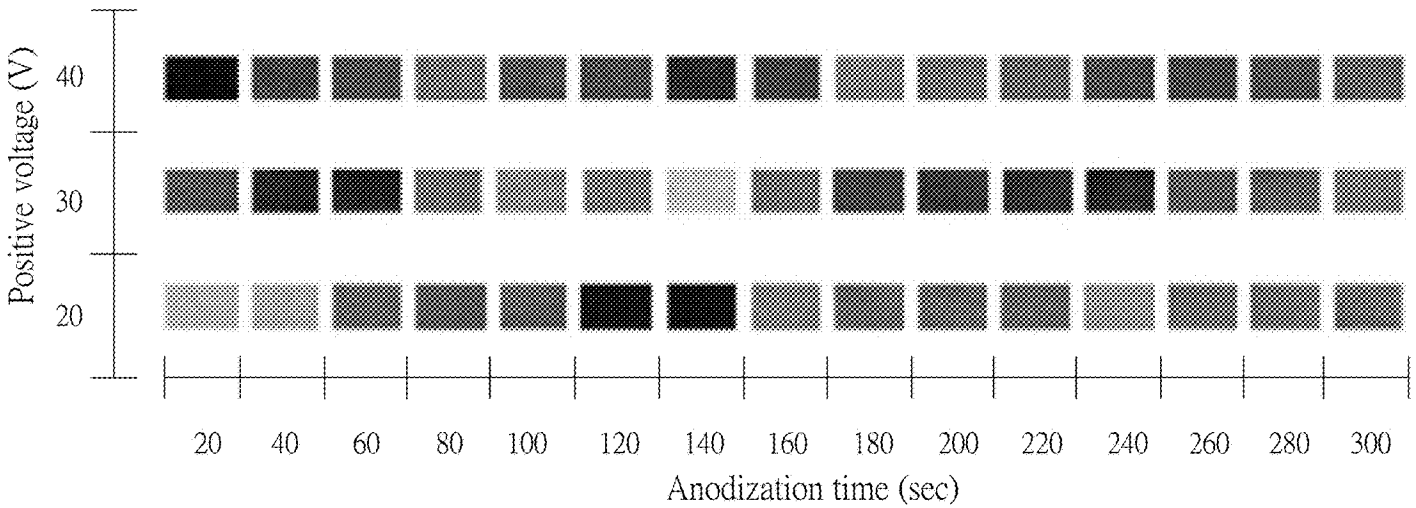
FIG. 5A shows substrates with different colors produced by different positive voltages applied in combination with different anodization time of an embodiment according to the present invention.

In this experiment, a substrate containing aluminum with a purity of 99.99% is used. The substrate is treated by the anodizing process at room temperature (25° C.) with 5 different pulse signals applied. The positive voltage is 20 V, 30 V, 40 V, 50 V, and 60 V respectively while the negative voltage applied is −2 V. The operation period is 2 seconds (1 second for the part with positive voltage and 1 second for the part with negative voltage). A three-electrode potentiostat (Jiehan 5000, Taiwan) is used to perform the anodizing process for 0 to 300 seconds (anodization time ($t_1$)). An aluminum plate is used as the working electrode, a platinum wire serves as the counter electrode and the reference electrode is Ag/AgCl. 0.3 M oxalic acid solution is used as the electrolyte. The anodizing time is ranging from 0 second to 300 seconds. Thus the relationship between the positive voltage and the anodization time is observed. Then the substrate with different anodization time is soaked in a 5% (wt %) phosphoric acid solution at room temperature for the pore-widening process. At last, the surface of the substrate is coated with a platinum (Pt) layer. The current is set at 20 mA and the coating time is 2 minutes. As shown in FIG. 5A, the substrates produced by different positive voltage (including 20 V, 30 V, 40 V) and anodization time have different colors on surface thereof while the results of 50 V and 60 V are shown in FIG. 6A.

Figure 5B:
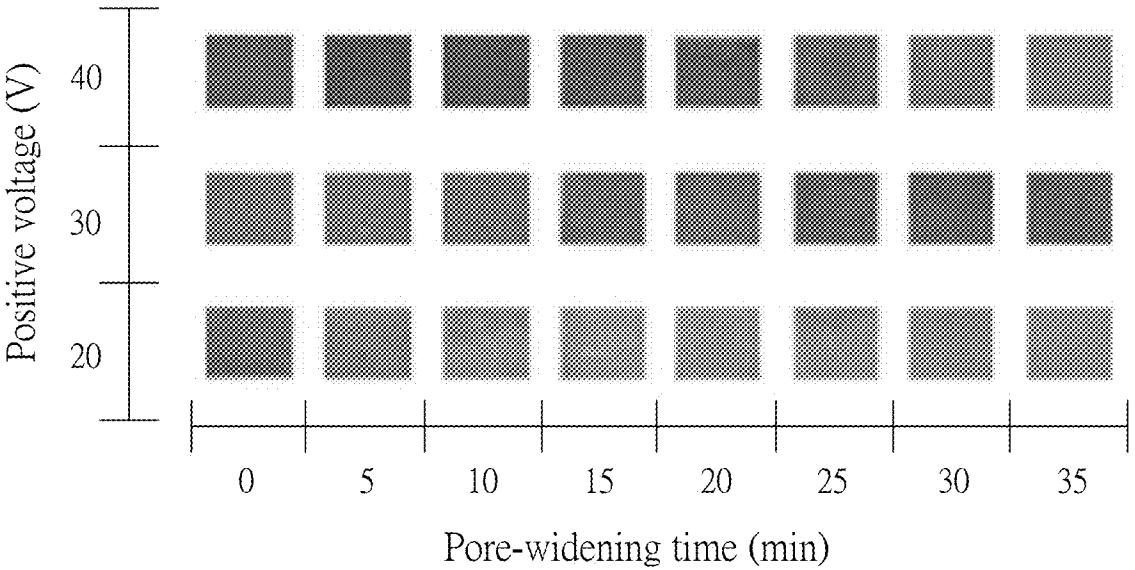
FIG. 5B shows substrates with different colors produced by different positive voltages applied in combination with different pore-widening time of an embodiment according to the present invention.

Moreover, the substrate treated by the anodizing process for 300 seconds is soaked in a 5% (wt %) phosphoric acid solution at room temperature for the pore-widening process. In order to observe the relationship between the positive voltage and the pore-widening time, the pore-widening time is set at 0 min, 5 min, 10 min and 35 min respectively. After completing the pore-widening, the surface of the substrate is also coated with a platinum (Pt) layer. The substrates produced by different positive voltages and pore-widening time have different colors on surface thereof, as shown in FIG. 5B.

Use a spectroscope (Hitachi U-4100) to measure the interference wavelength of the porous aluminum oxide layer of the colored substrate (shown in FIG. 5A). Then perform a linear regression of the interference wavelength (the first interference wavelength) versus the anodization time (the first period of time $t_1$) and the results are shown in FIG. 6A. A linear function obtained is the following equation when the positive voltage is 20 V:

$$\lambda=2.06t_1+67.0 \quad \text{(equation 1)}$$

λ is the interference wavelength of the porous aluminum oxide layer and the unit is nm while $t_1$ is the anodization time and the unit is second.

Similarly, the linear function obtained is the following equation 2, equation 3, equation 4 and equation 5 when the positive voltage is 30 V, 40 V, 50 V and 60 V respectively.

$$\lambda=3.53t_1+130.6 \quad \text{(equation 2)}$$

$$\lambda=6.38t_1+118.4 \quad \text{(equation 3)}$$

$$\lambda=16.85t_1-115.6 \quad \text{(equation 4)}$$

$$\lambda=36.92t_1-125.2 \quad \text{(equation 5)}$$

λ is the interference wavelength of the porous aluminum oxide layer and the unit is nm while $t_1$ is anodization time and the unit is second.

Figure 6B:
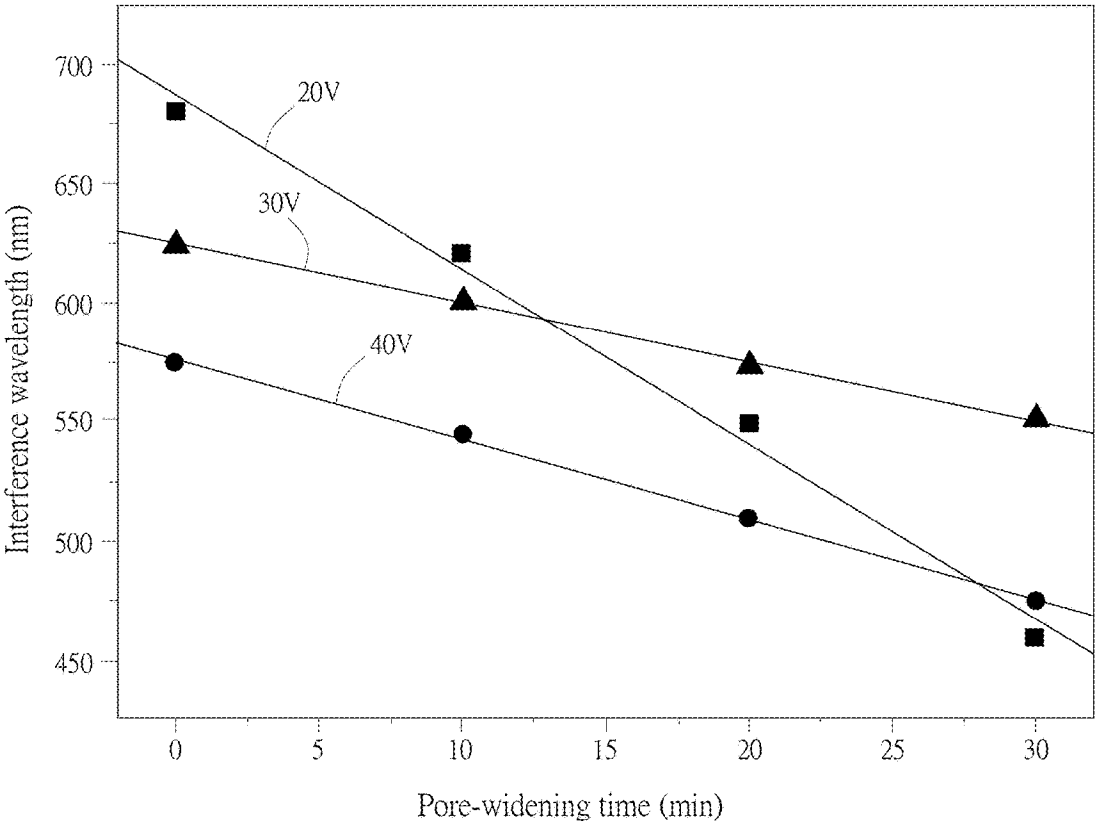
FIG. 6B shows results of a linear regression of the second interference wavelength versus the pore-widening time of a porous aluminum oxide layer of a colored substrate being applied with different positive voltages of the embodiments in FIG. 5B according to the present invention.

Use a spectroscope (Hitachi U-4100) to measure the interference wavelength of the porous aluminum oxide layer of the colored substrate (shown in FIG. 5B). Then perform a linear regression of the interference wavelength (the second interference wavelength) versus the pore-widening time (the second period of time $t_2$, unit min) and the results are shown in FIG. 6B. The linear function obtained is the following equation 6, equation 7, and equation 8 when the positive voltage is 20 V, 30 V, and 40 V respectively and the anodization time is 300 seconds.

$$\lambda=-7.31t_2+687.4 \quad \text{(equation 6)}$$

$$\lambda=-3.35t_2+625.2 \quad \text{(equation 7)}$$

$$\lambda=-2.63t_2+576.5 \quad \text{(equation 8)}$$

λ is the interference wavelength of the porous aluminum oxide layer and the unit is nm while $t_2$ in the equation 6, equation 7 and equation 8 is the pore-widening time and the unit is min.

In order to produce a substrate with grass green on a surface thereof (as shown in FIG. 5A and FIG. 5B), the positive voltage of one-time anodization (step S20) is set at 40 V and the first period of time is set to 300 seconds in the first embodiment, or the positive voltage of one-time anodization (step S20) is set at 30 V, the first period of time is set to 300 seconds, and the time required for the step S21 (pore-widening treatment) is set to 15 minutes.

Thus users can calculate the positive voltage, the anodization time, and the pore-widening time according to the wavelength of a specific color required and the linear function obtained by linear regression once they want to produce a colored substrate with the specific color.

Figure 7A:
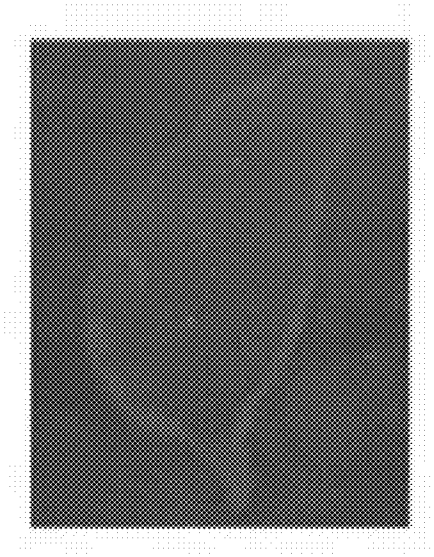
FIG. 7A and FIG. 7B shows colored substrates having two areas with different colors of an embodiment according to the present invention.
Figure 7B:
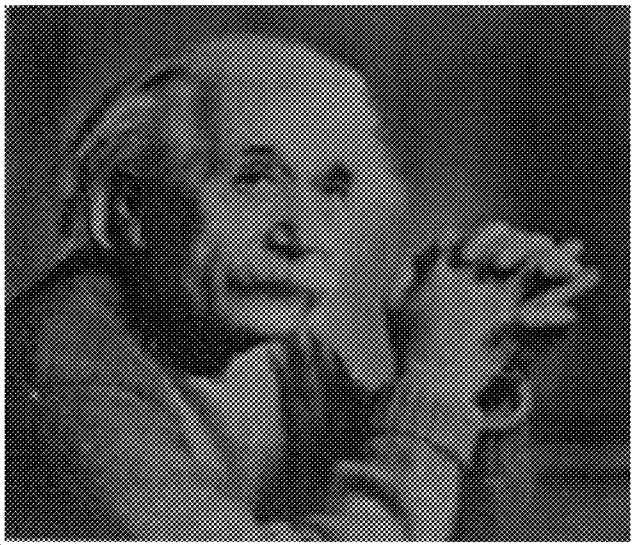

Experiment three: preparation of colored substrate with two colors on surface area thereof Refer to FIG. 7A and FIG. 7B, the substrate containing aluminum is treated by the anodizing process at room temperature. The positive voltage applied is 40 V, and the negative voltage applied is −2 V. The operation period is 2 seconds (1 second for the part with positive voltage and 1 second for the part with negative voltage). The three-electrode potentiostat (Jiehan 5000, Taiwan) is used for the anodizing process. An aluminum plate is used as the working electrode, a platinum wire serves as the counter electrode and the reference electrode is Ag/AgCl. 0.3 M oxalic acid solution is used as the electrolyte. Then photoresist is coated on a part of the area of the substrate by spin coating (such as the area with the shape of Taiwan shown in FIG. 7A and Einstein image shown in FIG. 7B). In the experiment of Taiwan map, the substrate anodization time is 200 seconds and a positive photoresist S1813 is used. The spin speed is set at 500 rpm for 15 seconds firstly and then is accelerating to 3000 rpm for 32 seconds. After a mask being selected, the photoresist is exposed to a 325 nm UV light (15 W) for 150 seconds and developed for 10 seconds. Next the substrate coated with the photoresist is treated by a first-time pore-widening process for 24 minutes. The parameters of the pore-widening process are the same as those in the first experiment mentioned above. After the UV photoresist being removed, a second-time pore-widening process is carried out for 8 minutes. At last, the surface of the substrate is coated with a platinum layer. The current is set at 20 mA and the coating time is 2 minutes. In the experiment of Einstein image, performing the same photoresist lithography with the "Einstein" grayscale mask on the substrate, then anodizing for 50 seconds and then remove photoresist for the resulting image.

As shown in FIG. 7A, the area coated with the UV photoresist (with the shape of Taiwan in the figure) is processed only by a 8 min subsequent pore-widening treatment once while the rest area without the UV photoresist coating is prepared by a 24 min pore-widening treatment and a subsequent 8-min pore-widening treatment (total 32 min) Thus two different colors are shown in respective area of the substrate.

In order to get or enhance the color together with pattern, people skilled in the art can produce colored substrates according to the method of the present invention and followed by other treatments including painting, dyeing, etc. Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents. The present invention has been approved by intellectual property office of Taiwan, the Taiwan Patent No. 1553165 "Coloring method by dye-free and one-time anodic-aluminum oxidizing process and substrate made therefrom".

What is claimed is:

1. A method for dye-free coloring of a one-time anodic aluminum oxide surface, the method comprising the steps of:

providing a substrate containing aluminum;

performing one-time anodizing of the substrate containing aluminum at room temperature, the one-time anodizing including applying a pulse signal to the substrate containing aluminum for a plurality of first periods of time to thereby form a porous aluminum oxide layer on a surface of the substrate containing aluminum, wherein the pulse signal includes a part with positive voltage and a part with negative voltage;

depositing a metal film on the porous aluminum oxide layer;

performing a linear regression of a plurality of first interference wavelengths of the porous aluminum oxide layer having the metal film deposited thereon versus the plurality of first periods of time, wherein an absolute value of a slope of a regression line obtained ranges from 1.8 to 38.5 and is positively correlated with the positive voltage of the pulse signal; and determining, from the linear regression, a desired positive voltage and a desired first period of anodizing time for obtaining a desired color of the porous aluminum oxide layer.

2. The method as claimed in claim 1, wherein:

the positive voltage of the pulse signal is ranging from 20 Volts to 60 Volts;

the absolute value of the slope of the regression line is 2.0±0.5 when the positive voltage is set as 20 V;

the absolute value of the slope of the regression line is 3.5±0.5 when the positive voltage is set as 30 V;

the absolute value of the slope of the regression line is 6.4±0.5 when the positive voltage is set as 40 V;

the absolute value of the slope of the regression line is 16.8±0.5 when the positive voltage is set as 50 V; and the absolute value of the slope of the regression line is 36.9±0.5 when the positive voltage is set as 60 V.

3. The method as claimed in claim 1, wherein:

the method further includes a step of immersing the substrate containing aluminum with the porous aluminum oxide layer in an etching solution to perform a pore-widening process for a plurality of second periods of time at least once;

the porous aluminum oxide layer having the metal film deposited thereon has a plurality of second interference wavelengths;

a linear regression of the plurality of second interference wavelengths versus the plurality of second periods of time is carried out and an absolute value of a slope of a regression line obtained ranges from 1.5 to 8.0; and the absolute value of the slope of the regression line between the second interference wavelength and the second period of time is negatively correlated with the positive voltage of the pulse signal.

4. The method as claimed in claim 3, wherein:

the absolute value of the slope of the regression line is 7.3±0.5 when the positive voltage is set as 20 V;

the absolute value of the slope of the regression line is 3.4±0.5 when the positive voltage is set as 30 V; and the absolute value of the slope of the regression line is 2.6±0.5 when the positive voltage is set as 40 V.

5. The method as claimed in claim 3, wherein:

the surface containing aluminum with the porous aluminum oxide layer is disposed with a protective layer before the step of immersing the substrate containing aluminum with the porous aluminum oxide layer in the etching solution; and the protective layer is removed after the pore-widening process and then the surface containing aluminum with the porous aluminum oxide layer is immersed in the etching solution to perform the pore-widening process again.

6. The method as claimed in claim 3, wherein the step of immersing the substrate containing aluminum with the porous aluminum oxide layer in the etching solution to perform the pore-widening process at least once is for allowing the substrate containing aluminum to have various interference wavelengths and different optical properties/colors.

7. The method as claimed in claim 5, wherein the protective layer is made from material selected from the group consisting of positive photoresist, negative photoresist, tape, and screen-printing inks.

8. The method as claimed in claim 1, wherein the substrate containing aluminum is selected from the group consisting of a substrate made of pure aluminum, an aluminum alloy substrate, a substrate coated with an aluminum layer, and a substrate deposited with an aluminum alloy layer.

9. The method as claimed in claim 8, wherein a thickness of the aluminum layer is ranging from 10 nm to 1000 nm.

10. The method as claimed in claim 1, wherein the metal film is made from metal whose reflectivity is higher than 70% and a thickness of the metal film is ranging from 5 nm to 25 nm.

11. The method as claimed in claim 1, wherein the metal film is made of material selected from the group consisting of platinum (Pt), aluminum (Al), silver (Ag), gold (Au), iron (Fe), nickel (Ni), cobalt (Co), chromium (Cr), titanium (Ti), Tantalum (Ta), copper (Cu), and their alloys.

12. The method as claimed in claim 1, wherein the room temperature is ranging from 15 degrees Celsius (° C.) to 35° C.

13. The method as claimed in claim 1, wherein the step of performing one-time anodizing of the substrate containing aluminum at room temperature is carried out in an acid solution whose concentration is ranging from 0.1 M to 0.9 M.

14. The method as claimed in claim 13, wherein the acid solution is selected from the group consisting of oxalic acid solution, sulfuric acid solution and organic acid solution.

15. The method as claimed in claim 1, wherein a waveform of the pulse signal is selected from the group consisting of a square wave, a sine wave, a triangle wave and a sawtooth wave.

16. The method as claimed in claim 1, wherein an absolute value of the part of the pulse signal with positive voltage is larger than an absolute value of the part of the pulse signal with negative voltage.

17. The method as claimed in claim 1, further comprising performing one-time anodizing of a target substrate containing aluminum at room temperature, the one-time anodizing including applying an ideal pulse signal to the target substrate containing aluminum for the desired first period of anodizing time to thereby form a porous aluminum oxide layer on a surface of the substrate containing aluminum, wherein the ideal pulse signal includes a part with the desired positive voltage and a part with negative voltage.

* * * * *